United States Patent [19]

Rudy, Jr. et al.

[11] Patent Number: 4,726,791

[45] Date of Patent: Feb. 23, 1988

[54] POLARIZING SYSTEM FOR CONNECTORS

[75] Inventors: William J. Rudy, Jr., Annville; Howard R. Shaffer, Millersburg; Daniel E. Stahl, Dauphin, all of Pa.

[73] Assignee: AMP Incorporated, Harrisburg, Pa.

[21] Appl. No.: 42,084

[22] Filed: Apr. 24, 1987

[51] Int. Cl.[4] ..... H01R 13/64

[52] U.S. Cl. ..... 439/677; 439/681

[58] Field of Search ..... 439/681, 680, 677, 678, 439/679, 709, 888, 724, 78, 55, 715, 732

[56] References Cited

U.S. PATENT DOCUMENTS

| | | | |
|---|---|---|---|
| 3,399,374 | 8/1968 | Pauza | 439/355 |
| 3,611,272 | 10/1971 | Fairbain | 439/681 |
| 3,714,617 | 1/1973 | Bright et al. | 439/681 |
| 3,944,316 | 3/1976 | Newman et al. | 439/681 |
| 4,035,047 | 7/1977 | Ammon | 439/78 |
| 4,277,126 | 7/1981 | Lincoln | 439/681 |
| 4,376,565 | 3/1983 | Brird et al. | 439/681 |
| 4,519,667 | 5/1985 | Canning et al. | 439/681 |

*Primary Examiner*—Gil Weidenfeld
*Assistant Examiner*—Thomas M. Kline
*Attorney, Agent, or Firm*—Anton P. Ness

[57] ABSTRACT

A receptacle connector (10) has a plurality of plug-receiving cavities (24) defined along major sides by either outer major walls (36,38) of the receptacle hood (20) or by lengths of polarizing walls (28) parallel thereto, and along minor sides or ends thereof by minor walls (42) of the hood (20). Individual plug connector modules (100) such as single-row modules (100) receivable into the cavities (24) each include along one major side (124) thereof an elongate polarizing recess (128) to receive a polarizing wall (28). One outer major wall (38) of the hood (20) includes an elongate inward boss (44) shaped to act as a polarizing wall portion (144) from an end module, and the plug connector modules (100) when ganged together (210) will enter the receptacle section defined by the hood (20) only when in a proper polarized orientation. Key members (50) at each end of each cavity (24) correspond to key members (50) at each end of each plug connector module (100) to permit mating of a module (100) in the cavity (24) only when the opposing keys (50,50) are in proper keying relationship to each other. The polarizing and keying system practically eliminates mating of ganged plug connector modules with an undesired receptacle connector in an array of similar receptacle connectors, in a manner minimizing stress on the key members and their retention mechanisms.

6 Claims, 7 Drawing Figures

POLARIZING SYSTEM FOR CONNECTORS

FIELD OF THE INVENTION

This invention relates to the field of electrical connectors and more particularly to polarization system therefor.

BACKGROUND OF THE INVENTION

When a plurality of like first connectors and like second connectors matable therewith are used in the same vicinity, it is important to provide means to permit mating of particular pairs intended to be mated to each other, while preventing mating of pairs not intended to be mated to each other. This may be accomplished by use of visual coding such as indicia, but is much preferred to be accomplished by keying mechanisms which physically prevent mating of connectors not intended to be mated to each other while allowing desired mating of appropriate pairs. In one manner of keying, key members are known which are secured in one of the first and second connectors which cooperate with opposing key members of the other. Each key member is secured in a selected orientation with respect to its opposing key member so that forward structure of both pass by each other during mating; if another like connector is used in place of one of them, with its key member oriented differently, the forward structure of the opposing key members will abut and prevent further axially forward movement and thereby prevent mating. Orientation of a key member in a connector can be accomplished by using a member of regular polygonal cross-section secured in a passageway of like cross-section, with the number of sides of the polygon determining the number of orientations available from which to select. Using a pair of key members increases the number of keying arrangements to equal the square of the number of sides of the polygon.

Polarizing first and second symmetrical or round connectors by another physical means such as using a polarizing key of one connector insertable into a corresponding channel of the other, will require the connectors to be placed in a proper angular orientation with respect to each other in order to begin mating engagement prior to key members having their forward structure meet each other. Polarization preserves the full number of keying arrangements in symmetrical connectors, instead of allowing mating of a first connector with one arrangement improperly with a second connector whose keys have an arrangement diametrically opposed to the one arrangement.

It is desired to provide polarization of a plurality of elongate plug connectors to be spaced side-by-side for mating to a corresponding single receptacle connector, in a manner which permits close spacing.

It is further desired to provide separate cavity sections in the receptacle connector with substantially narrow planar walls therebetween.

It is still further desired to provide a polarization means in the receptacle connector which does not require use of structure at ends of narrow plug-receiving cavities, so that the cavity ends can be utilized for means to align a narrow plug connector for insertion into a respective narrow cavity.

SUMMARY OF THE INVENTION

The present invention provides a system of polarizing and keying a plurality of individual plug connector modules receivable into respective cavities of a receptacle connector for mating. A peripheral hood surrounds all the cavities, while the individual cavities are separated by narrow planar polarizing barrier walls extending almost from one end of the receptacle connector to the other. Each plug connector module includes along one of its two major sides a polarizing recess adapted to receive thereinto a respective polarizing barrier wall when the module is axially aligned with its receptacle cavity and is inserted into the cavity in the appropriate polarized orientation: the module is so dimensioned not to be able to enter the cavity when not in the appropriate polarized orientation. After proper polarizing is achieved and a plug module is aligned and begins to enter its cavity, key members at each end of the module meet opposing key members at each end of the cavity. If the key members are in appropriate keying orientation to each other, the module may now be fully inserted into the cavity achieving a fully mated condition with the receptacle connector. The initial engagement of plug module housings with the polarizing barrier walls means that much of the impact from attempted housing structure instead of key members, relieving stress on the key members and their retention mechanisms and also reducing wear thereon. Incorrectly oriented modules can then be repositioned to the proper polarized orientation.

It is an object of the invention to provide a polarization means for elongate single row plug connectors and receptacle cavities along the elongate sides of the plug and cavity sections, rather than at the ends thereof to allow the ends to be used to axially align the respective plug connector and receptacle cavity relative to each other.

It is a further objective to provide a polarization means in cooperation with a keying means along their elongate sides which simplifies the plug and receptacle structure and reduces the necessary wall thickness of both to allow closer spacing of terminal rows and of adjacent modules and connectors.

DETAILED DESCRIPTION OF THE PREFERRED EMBODIMENT

Figure 1:
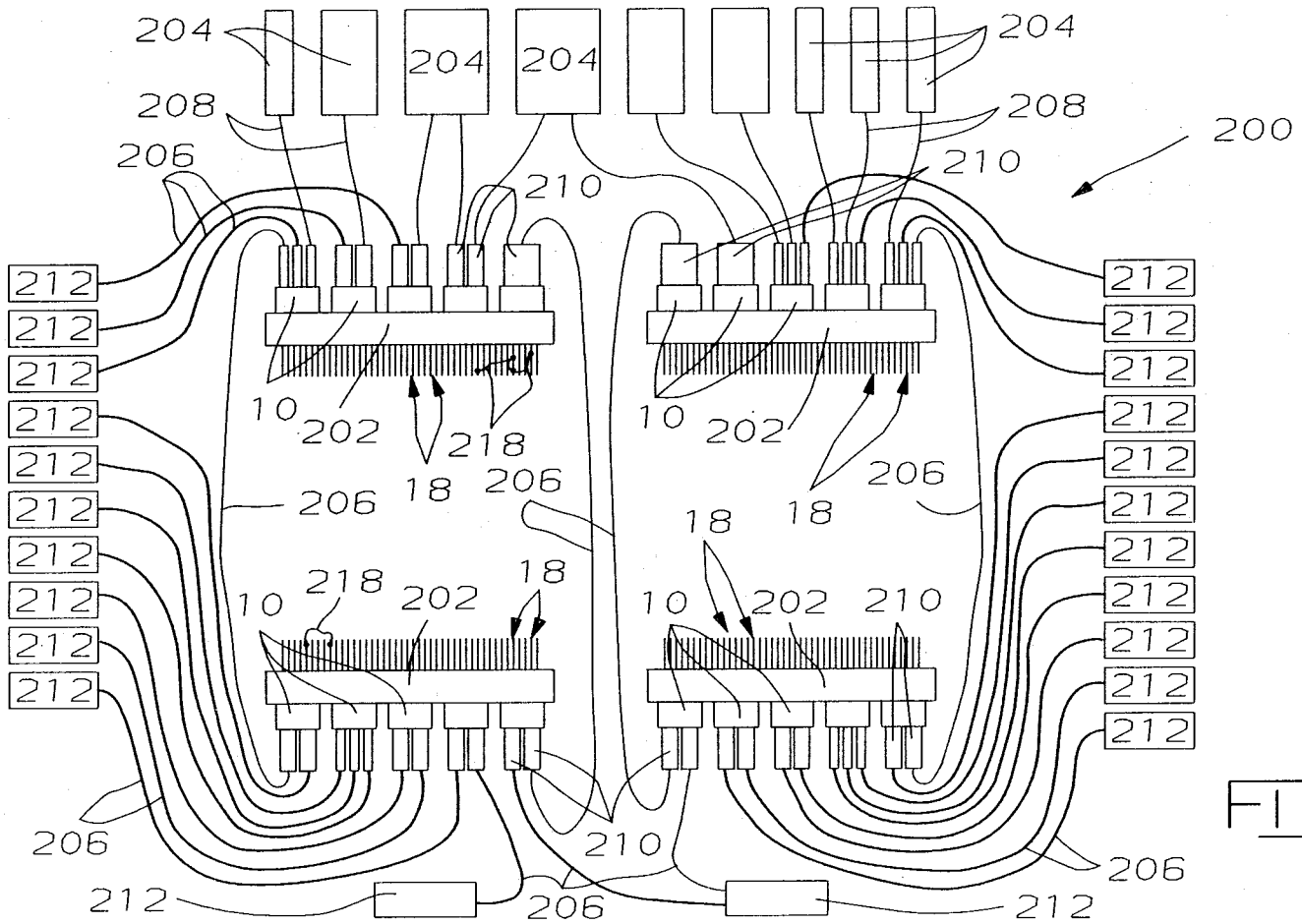
FIGS. 1 and 2 are schematic and perspective views of a wire integration system with which the present invention may be used.
Figure 2:
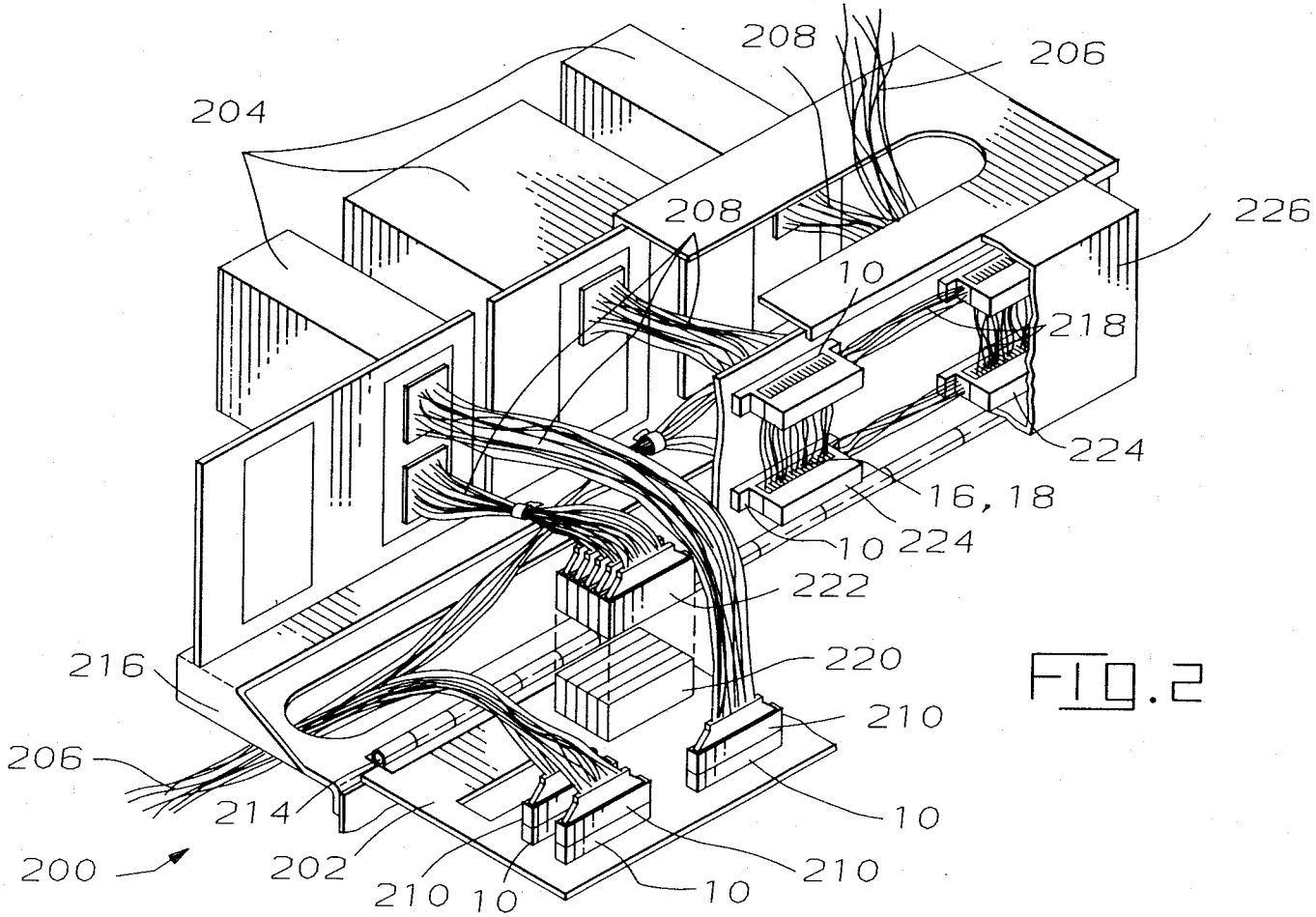

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or harnesses terminated at one end by modular plug connectors 210 which extend to a wire integration panel 202 on which are mounted receptacle connectors 10 matable at one face of the panel with plug connectors 210.

Along the face of the panel opposed from the face receiving plug connectors 210, in the embodiment shown, terminals 16 of receptacle connectors 10 are secured in housings 12 and have wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover plate 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
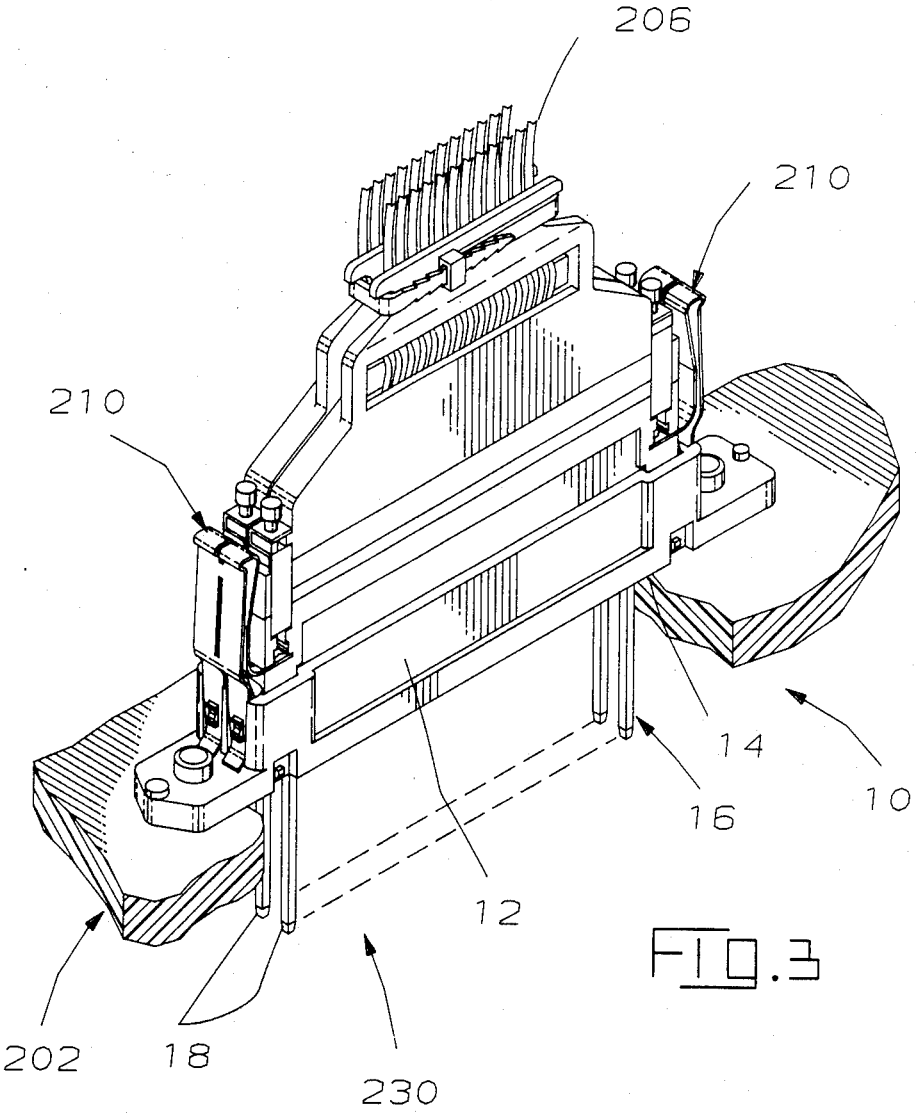
FIG. 3 is a perspective view of mated plug and receptacle connectors for use on a wire integration panel of the system of FIGS. 1 and 2.

FIG. 3 shows a two-row plug connector 210 mated with a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. patent application Ser. Nos. 42,205; 42,495; 42,201; 42,203; and 42,418 all filed Apr. 24, 1987 and all assigned to the assignee hereof.

Figure 4:
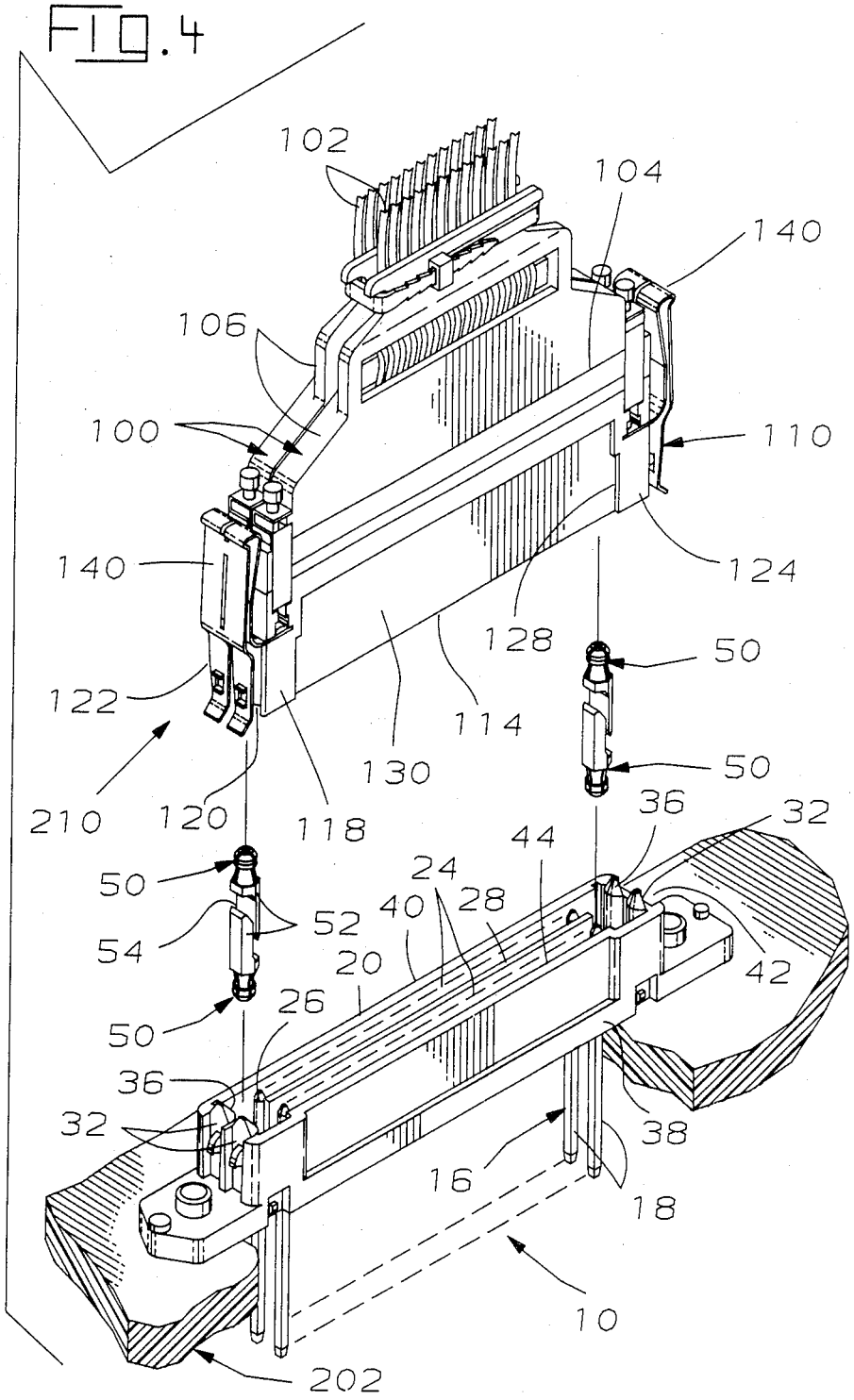
FIG. 4 is a perspective view of an assembly of two single-row plug connector modules ganged together as a unit for mating with a two-row receptacle connector.
Figure 5:
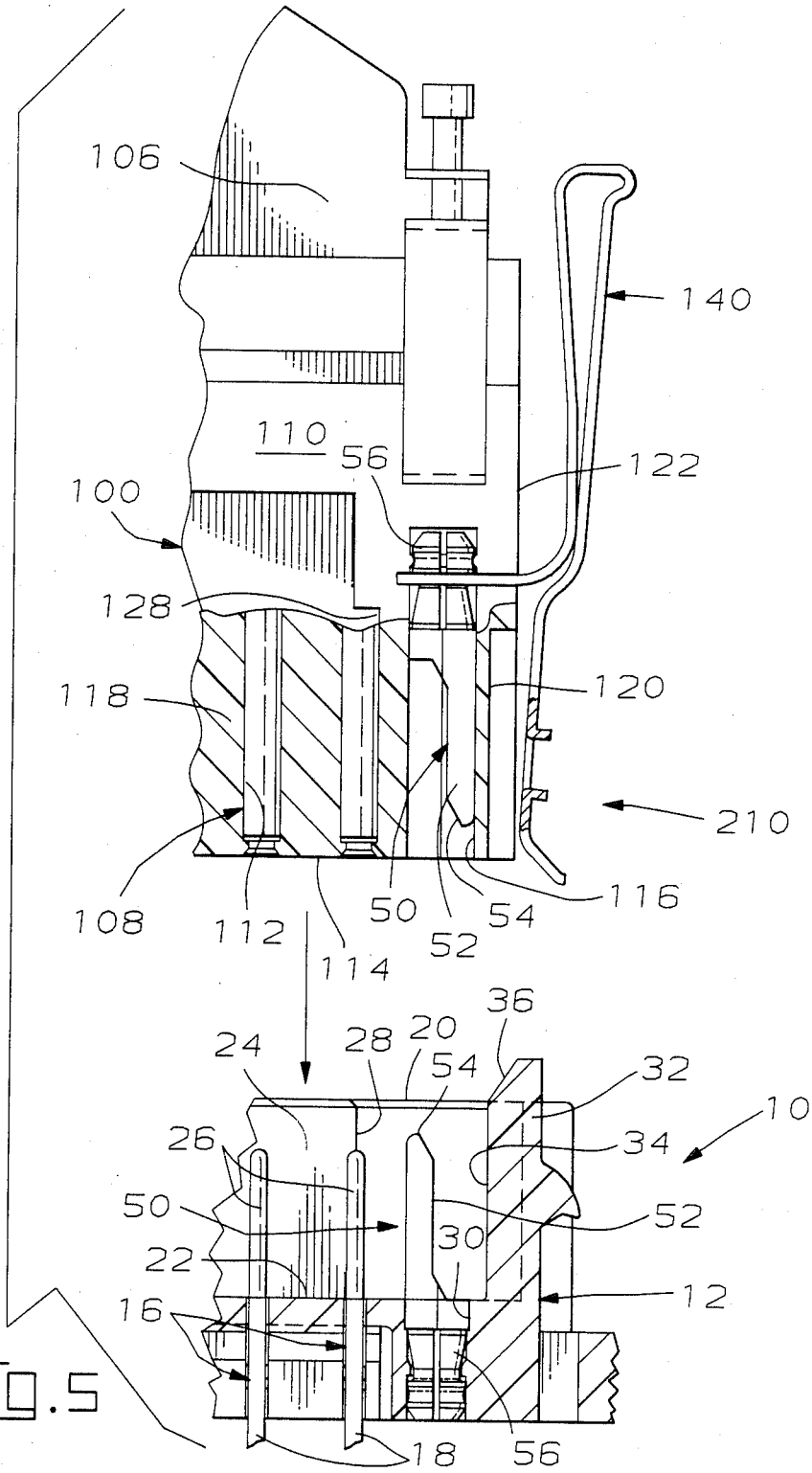
FIGS. 5 and 6 are part section views of one module spaced from and then in mated engagement with a receptacle connector.

Two-row plug connector assembly 210 is shown in FIG. 4 to comprise two single-row plug connector modules 100 ganged together in side-by-side relationship, each receiving an array of electrical conductor cables 102 in a cable face 104, with each array of cables 102 firmly engaged by a strain relief 106 of each module 100. Referring to FIG. 4 and 5, terminals 108 such as socket contacts are terminated to conductors 102 and are secured within module housings 110 within terminal-receiving passageways 112 extending rearwardly from mating face 114. Each module housing 110 includes a key-receiving passageway 116 at each end of the row of terminal-receiving passageways 112 also extending rearwardly from mating face 114, to receive and secure thereinto a key member 50. Modules 100 are ganged together by a pair of integral spring latch members 140 more particularly described in above-mentional application Ser. No. 42,201. Key members 50 are preferably secured in plug modules 100 by retention sections 56 as is more particularly described in above-mentioned application Ser. No. 42,495.

Receptacle connector 10 comprises a receptacle housing 12 generally having a peripheral hood 20 defining a receptacle section forwardly of mating face 22 to receive a forward section of plug connector assembly 210 thereinto during mating. The receptacle section is generally comprised of individual plug-receiving portions or cavities 24 associated with forward plug sections 118 of individual plug modules 100. Within cavities 24 and therealong is a row of contact sections 26 of terminals 16, such as pin contacts, with forward ends of the contact sections recessed from leading edge surfaces of hood 20. Cavities 24 are separated from each other by lengths of narrow planar polarizing barrier walls 28 with walls 28 extending preferably as far forwardly from mating face 22 as does hood 20 and extending to just beyond end ones of contact sections 26. Near both ends of each cavity 24 are key-receiving passageways 30 within each of which is secured a key member 50 by means of retention section 56 (FIG. 5), with key member 50 disposed in a selected keying orientation, with a forwardly extending keying section 52 extending into plug-receiving cavity 24. At both ends of each cavity 24 are disposed alignment posts 32 having semicylindrical inwardly facing surfaces 34 and tapered forward post ends 36 which extend forwardly beyond the leading edge surfaces of hood 20 and barrier walls 28. Alignment posts 32 enter corresponding alignment channels 120 along end surfaces 122 of a module 100 during the initial stage of mating of the connectors, which action aligns each of ganged modules 100 both spatially and axially.

Receptacle connector 10 has long opposing major sides 38,40 and opposing minor sides 42. Polarizing barrier walls 28 are parallel to major sides 38,40 and extend from a location proximate one of minor sides 42 to the other. Similarly, each plug module 100 has major sides 124,126 extending between end surfaces 122. Major sides 124 each have an elongated polarizing recess 128 extending rearwardly therealong from mating face 114 and corresponding to a polarizing barrier wall 28 of receptacle connector 10 being shaped to receive wall 28 therealong during mating when modle 100 is properly oriented for insertion into cavity 24. To provide a polarizing means for the end module un plug connector assembly 210, major side 38 of hood 20 has an inwardly exteding elongated boss 44 shaped as a polarizing barrier wall to extend along a polarizing recess 128 of the end module. Consistent with the use of polarizing walls 28 and recesses 128, each plug module housing 110 is dimensioned between major sides 124 and 126 to be wider than the width of each plug-receiving cavity 24 so as not to enter cavity 24 when not properly polarized. Also, an end of a module housing 110 cannot inadvertently even partially enter a cavity 24 at an odd angle and thus cause damage to contact sections 26 (which are slightly recessed).

The preferred hexagonal shape of keying sections 52 of keys 50, securable into correspondingly hexagonal portions of key-receiving passageways 116,30 of modules 100 and receptacle connector 10 respectively, provides for each plug module 100 and plug-receiving cavity 24 having a pair of such key members 50, thirty-six possible keying arrangements. However, the thirty-six arrangements include two sets of diametrically opposite arrangements. Therefore, the use of a polarizing means such as walls 28,44 and recesses 128 is necessary to achieve all thirty-six possible arrangements for each module and its cavity. When several such modules are ganged together, with their several more pairs of keys, the number of keying combinations increases geometrically for the ganged unit. Preservation of as many keying arrangements as possible is preferred, when a wire integration system 200 such as that of FIG. 2 comprises an array of many like two-row receptacle connectors 10 and plug connectors 210 or five-row plug and receptacle connectors 222,220.

Figure 6:
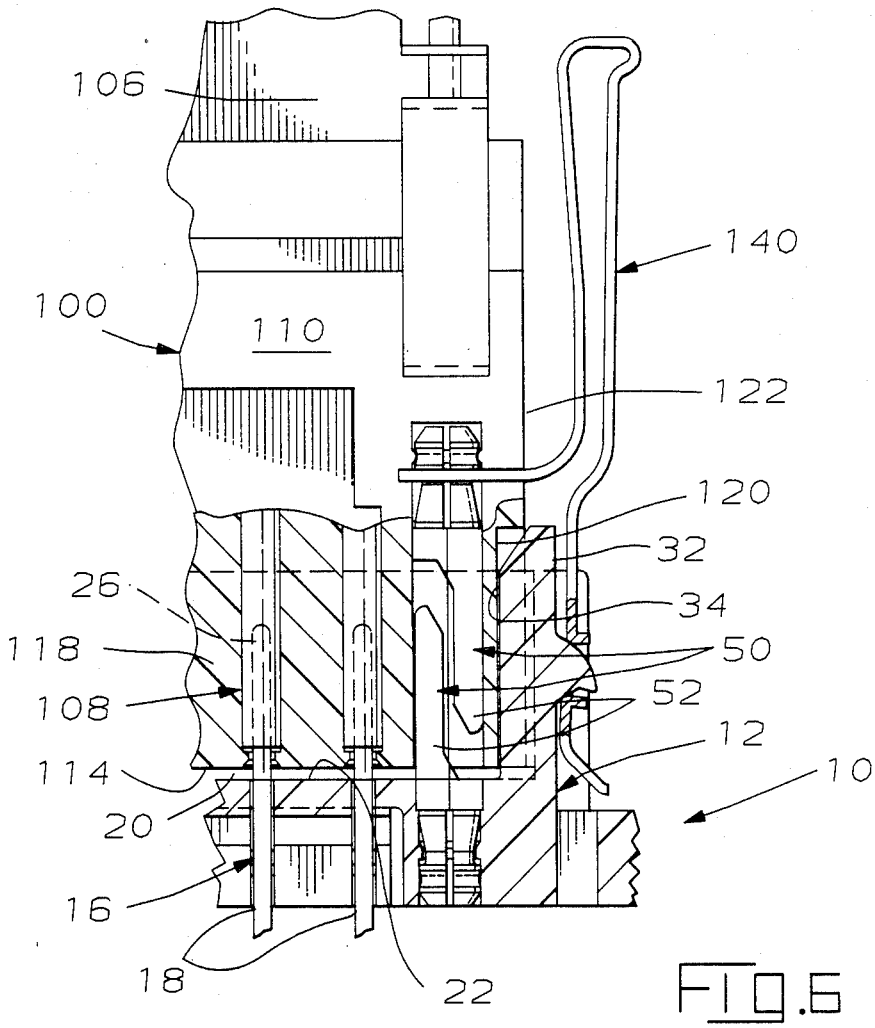

Referring to FIGS. 5 and 6, forward ends of polarizing walls 28,44 must enter recesses 128 (when modules 100 are aligned in a properly polarized orientation) after which leading ends 54 of keying sections 52 of corresponding opposed ones of key members 50 meet and pass by if the opposed key members are secured in module 100 and receptacle connector 10 in proper keying orientations with respect to each other. If such is the case, plug module 100 can be fully inserted into a respective cavity 24 whereupon contact sections of terminals 108 of module 100 mate with and electrically engage corresponding contact sections 26 of terminals 16 of receptacle connector 10.

With polarizing barrier walls 28,44 extending to the forwardmost portion of the receptacle section along with hood 20, physical engagement between a plug module 100 and receptacle connector 10 occurs between housing structure of both after the alignment posts begin to align the modules with respect to the cavities, all of which results in housing structure absorbing impact. Only then can leading ends 54 of corresponding opposing key members 50 arrive at each other to either pass by each other when properly oriented (meaning that the correct module is entering the correct cavity) or engage and stop further axial movement of module 100 into cavity 24 meaning that the particular module and the particular cavity are not the intended ones to mate with each other.

Figure 7:
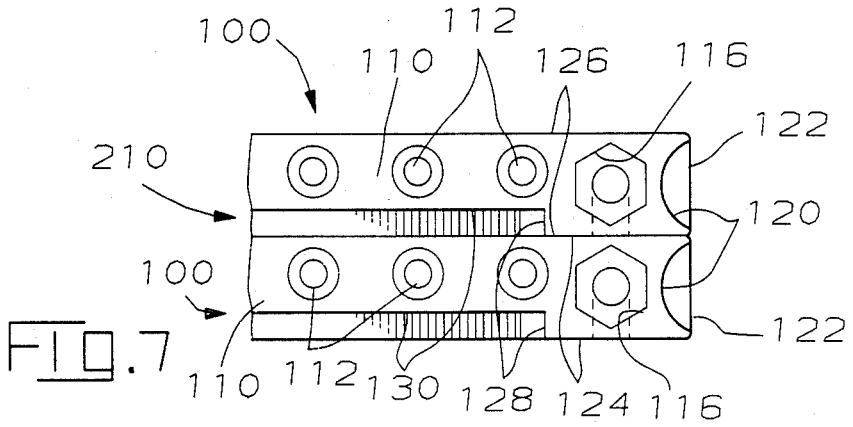
FIG. 7 is a part bottom view of a pair of plug modules showing the offset between the terminal passageways and key passageways.

Such a polarizing system of elongate walls and recesses eliminates the need for conventional keying ribs and keying channels, which require the housing structure along which they are disposed to be molded having a thicker dimension, to overcome structural weakness at least around conventional keying channels. With narrower housing walls now being possible herewith, closer spacing of rows of terminals in adjacent plug modules is possible. In FIG. 7, preferably the row of terminal passageways 112 of one of the modules is centered not between major sides 124 and 126 of that module, but between recess bottom 130 and major side 126 thereof, to optimize structural strength along elongated module housing 110 and minimize the tendency to warp therealong, while key-receiving passageways 116 remain centered between major side 124 and major side 126. Thus, terminal passageways 112 are laterally offset a slight distance from key-receiving passageways 116 equal to one-half the depth of recess 128. Rows of terminals 26 of receptacle connector 10 are similarly offset with respect to key members 50 and are centrally located within cavities 24.

Variations may be devised to the polarizing barrier walls and corresponding recesses, or to the particular shape and number of key members, which are within the spirit of the invention and the scope of the claims.

What is claimed is:

1. A system for polarizing and keying the mating engagement of a receptacle electrical connector with a plurality of modular plug electrical connectors comprising:

a plurality of modular plug connector means each including a dielectric housing means having a plurality of first electrical contacts secured therein having first contact sections proximate a first mating face, each said housing means being elongate and having elongated opposing major sides and opposing minor sides extending rearwardly from said first mating face, one of said major sides having an elongate polarizing recess extending therealong rearwardly from said first mating face from proximate one said minor side to proximate the other said minor side, each said housing means further including at least one key-receiving passageway adapted to receive thereinto from said first mating face a forwardly extending keying section of a corresponding second key member arranged in a corresponding keying orientation; and a receptacle connector means including a dielectric housing means having a plurality of second electrical contacts secured therein having second contact sections proximate a second mating face and adapted to mate with corresponding ones of said first electrical contacts to establish an electrical connection therebetween when said modular plug and receptacle connector means are mated, said receptacle housing means having a hood section extending forwardly from said second mating face and about the periphery thereof defining a receptacle section, said receptacle section having elongate opposing major sides associated with said major sides of said modular plug connector means and further having opposing minor sides associated with said minor sides of said modular plug connector means, said receptacle section including a like plurality of plug-receiving cavities parallel to said elongate major sides of said receptacle section and each associated with a selected one of said plurality of modular plug connector means;

each said plug-receiving cavity including near each end thereof proximate a said minor side at least one said forwardly extending keying section of a said second key member secured in said corresponding keying orientation in said receptacle housing means extending forwardly from said second mating face at a location appropriate for entering a said key-receiving passageway of said selected one of said modular plug connector means having a said first key member therein, each said plug-receiving cavity including associated therewith and being partially defined by a polarizing wall portion along one major side thereof extending forwardly from said second mating face and extending parallel to said receptacle section major sides from proximate one said minor side thereof to proximate the other said minor side and being adapted to enter a respective said polarizing recess along said one major side of said selected one of said modular plug connector means, said plug-receiving cavity having a dimension parallel to a said minor side at any location therealong just greater than the width of said selected one of said modular plug connector means at a corresponding location, and a forward end of said polarizing wall portion of each said plug-receiving cavity extending farther forwardly than forward ends of any of said forwardly extending keying sections and said second contact sections, whereby each said polarizing wall portion entering a said corresponding polarizing recess permits a said modular plug connector means to be moved farther axially forwardly into said respective plug-receiving cavity when said modular plug connector means is in a properly polarized orientation with respect to said plug-receiving cavity, and said forwardly extending keying sections of said second key members entering said corresponding key-receiving passageways of said modular plug connector means containing keying sections of corresponding said first key members permit said modular plug connector means to be moved still farther axially forwardly into said plug-receiving cavity for full mating when said first key members are secured in said modular plug connector means in respective proper keying orientations with respect to corresponding ones of said second key members, and said polarizing walls and recesses prevent mating of connectors having keying arrangements symmetrically opposed from the desired keying arrangements, all whereby each said plug-receiving cavity of said receptacle connector means permits entry of only an appropriately keyed and polarized one of said plurality of modular plug connector means for mating therewith.

2. A system as set forth in claim 1 wherein said housing means of said modular plug connector means are identical, and said plug-receiving cavities are identical.

3. A system as set forth in claim 2 wherein said hood section along one said major side of said receptacle section includes an elongate boss identical in size and shape to a said polarizing wall portion and comprises a polarizing means equivalent thereto.

4. A system as set forth in claim 3 wherein said polarizing wall portion of each said plug-receiving cavity is disposed along a side thereof remote from said elongate boss of said one major said of said receptacle section.

5. A system as set forth in claim 1 wherein a said modular plug connector means has one row of terminal therein and said first contact sections thereof are disposed along respective terminal passageways of said housing means thereof, said terminal passageways are aligned in one row offset with respect to said key-receiving passageways proximate each said minor side of said housing means, said row being disposed remote from said one major side having said polarizing recess therealong, and said second contact sections of said receptacle connector means corresponding to said offset row thereof, whereby said first contact sections are centered with respect to the bottom surface of said polarizing recess and the other said major side of said housing means, and said key-receiving passageways are centered between said opposing major sides of said housing means along both major sides thereof.

6. A system as set forth in claim 1 wherein said plurality of modular plug connector means are fastened together in side-by-side relationship along their major sides to be mated with said receptacle connector means as an integral plug connector assembly if all said first key members are secured therein in proper keying orientations corresponding with said keying orientations of said second key members of said receptacle connector means when said plug connector assembly is in a properly polarized orientation with respect to said receptacle connector means.

* * * * *